US005269051A

United States Patent [19]

McFalls

[11] Patent Number: 5,269,051

[45] Date of Patent: Dec. 14, 1993

[54] BUCKLE ASSEMBLY

[75] Inventor: Bob L. McFalls, Shelby Township, Macomb County, Mich.

[73] Assignee: TRW Vehicle Safety Systems Inc., Lyndhurst, Ohio

[21] Appl. No.: 941,966

[22] Filed: Sep. 8, 1992

[51] Int. Cl.[5] ..... A44B 11/26

[52] U.S. Cl. ..... 24/632; 24/637

[58] Field of Search ..... 24/573.5, 631, 632, 24/637, 633; 297/468

[56] References Cited

U.S. PATENT DOCUMENTS

| | | | |
|---|---|---|---|
| 4,457,052 | 7/1984 | Hauber . | |
| 4,646,400 | 3/1987 | Tanaka | 24/637 X |
| 4,757,579 | 7/1988 | Nishino et al. | 24/637 X |
| 5,023,981 | 6/1991 | Anthony et al. . | |
| 5,086,548 | 2/1992 | Tanaka et al. . | |

*Primary Examiner*—James R. Brittain

*Attorney, Agent, or Firm*—Tarolli, Sundheim & Covell

[57] ABSTRACT

A buckle assembly (36, 36A) for use in a safety belt system (10) has a first insertion path for receiving a first tongue (38) and a second insertion path spaced from the first insertion path for receiving a second tongue (40). A latch (50) mounted on a base (44) is movable between an engaged position blocking movement of the tongues out of the buckle assembly and a release position allowing movement of the tongues out of the buckle assembly. The latch has a tab portion (108) disposed intermediate the first and second tongue insertion paths which maintains the tongues in engagement with the latch when the tongues are inserted in the buckle assembly. The latch may include first and second latch members (50A, 50B) mounted on the base, for independently controlling latching of the first and second tongues in the buckle assembly. A pushbutton (88) is pivotally mounted on the base. The pushbutton is manually actuatable to move the latch from the engaged position to the release position to allow movement of the tongues out of the buckle assembly. A divider member (130) attached to the pushbutton at the mouth (68) of the buckle assembly guides the first tongue into the first insertion path and guides the second tongue into the second insertion path.

15 Claims, 5 Drawing Sheets

BUCKLE ASSEMBLY

FIELD OF THE INVENTION

The present invention relates to a buckle assembly, and particularly to a buckle assembly which is used with a safety belt in a child restraint system for use in a vehicle.

BACKGROUND OF THE INVENTION

A child restraint system for use in a vehicle commonly includes a buckle that is attached to a crotch belt which extends between the legs of a child. The buckle interconnects the crotch belt with a pair of shoulder belts that extend across the shoulders of the child. At the end of each shoulder belt is a tongue which latches into the buckle to secure the child in the child restraint system.

The tongues are inserted individually into the buckle assembly. Each tongue should be easily insertable into the buckle assembly so that it latches correctly and does not interfere with the insertion and latching of the other tongue. Also, if one tongue is already latched in the buckle assembly, it is preferable that insertion of the second tongue into the buckle assembly not disengage the first tongue from the buckle assembly.

SUMMARY OF THE INVENTION

The present invention is a buckle assembly for use in a safety belt system and for receiving first and second tongues. The buckle assembly has a first insertion path for receiving the first tongue and a second insertion path spaced from the first insertion path for receiving the second tongue. A latch mounted on a base is movable between an engaged position blocking movement of the tongues out of the buckle assembly and a release position allowing movement of the tongues out of the buckle assembly. A manually engageable member is movable from a first position to a second position to move the latch from the engaged position to the release position to allow movement of the tongues out of the buckle assembly.

The latch has a tab portion disposed intermediate the first and second tongue insertion paths for guiding the tongues into the buckle assembly. The tab portion projects between the two tongue insertion paths and maintains the tongues in alignment with the latch. The latch may be one single piece for latching both tongues. Alternatively, the latch may include separate first and second latch members mounted on the base. The first latch member latches the first tongue in the buckle assembly and the second latch member latches the second tongue in the buckle assembly. If the latch includes first and second latch members, the tab portion includes a first tab member on the first latch member and a second tab member on the second latch member. Both tab members are disposed intermediate the first and second tongue insertion paths. The first and second tab members guide the first and second tongues into the buckle assembly and maintain the tongues in alignment with the latch members.

The manually engageable member is preferably a pushbutton pivotable on the base from a first position to a second position to move the latch member to the release position to allow movement of the tongues out of the buckle assembly. A separate divider member is attached to the pushbutton at the mouth of the buckle assembly for guiding the first tongue into the first insertion path and for guiding the second tongue into the second insertion path.

BRIEF DESCRIPTION OF THE DRAWINGS

The foregoing and other features of the present invention will become more apparent to those skilled in the art to which the invention pertains upon reading the following description of preferred embodiments of the invention in view of the accompanying drawings, wherein.

DESCRIPTION OF PREFERRED EMBODIMENTS OF THE INVENTION

The present invention relates to a buckle assembly for use in a safety belt system and for receiving first and second tongues. The present invention is applicable to various buckle assembly constructions.

Figure 1:
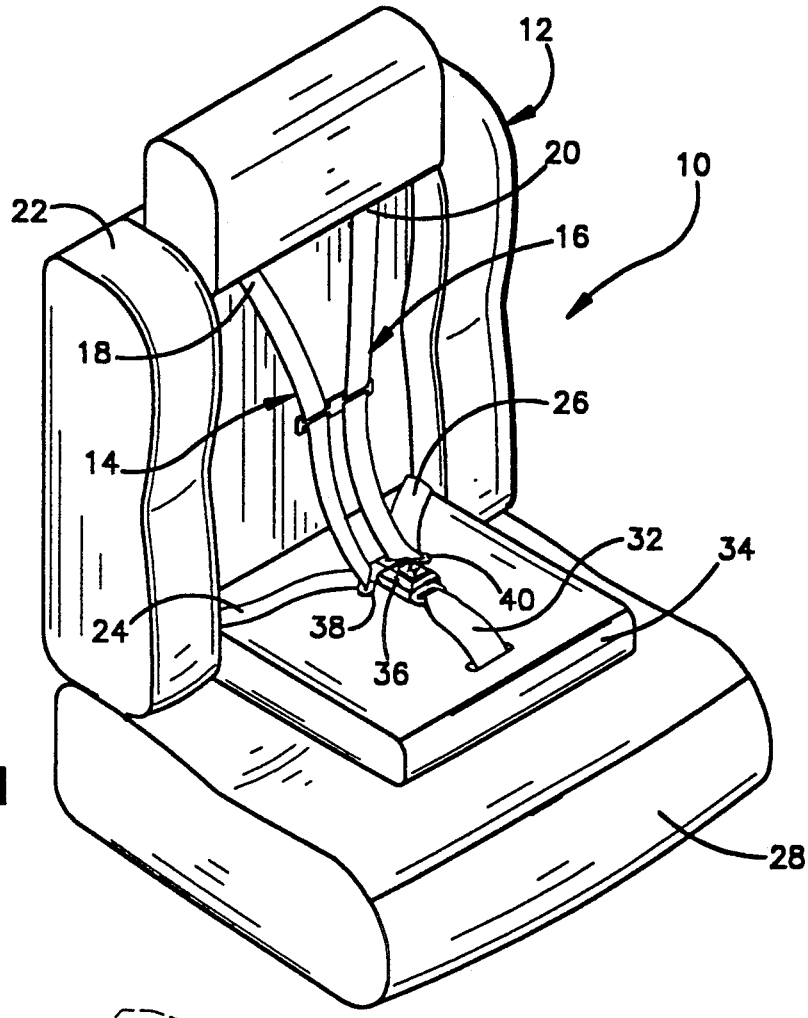
FIG. 1 a pictorial illustration depicting the relationship of child restraint system to a vehicle seat.

As representative of the present invention, FIG. 1 illustrates a child safety belt restraint system 10 in association with a vehicle seat 12. The child restraint system 10 includes a pair of shoulder belts 14 and 16. The shoulder belts 14 and 16 have upper end portions 18 and 20 which are secured to a back 22 of the vehicle seat 12. Lower end portions 24 and 26 of the shoulder belts 14 and 16 are secured to the vehicle seat 12 where the seat back 22 and a seat bottom cushion 28 come together.

Figure 2:
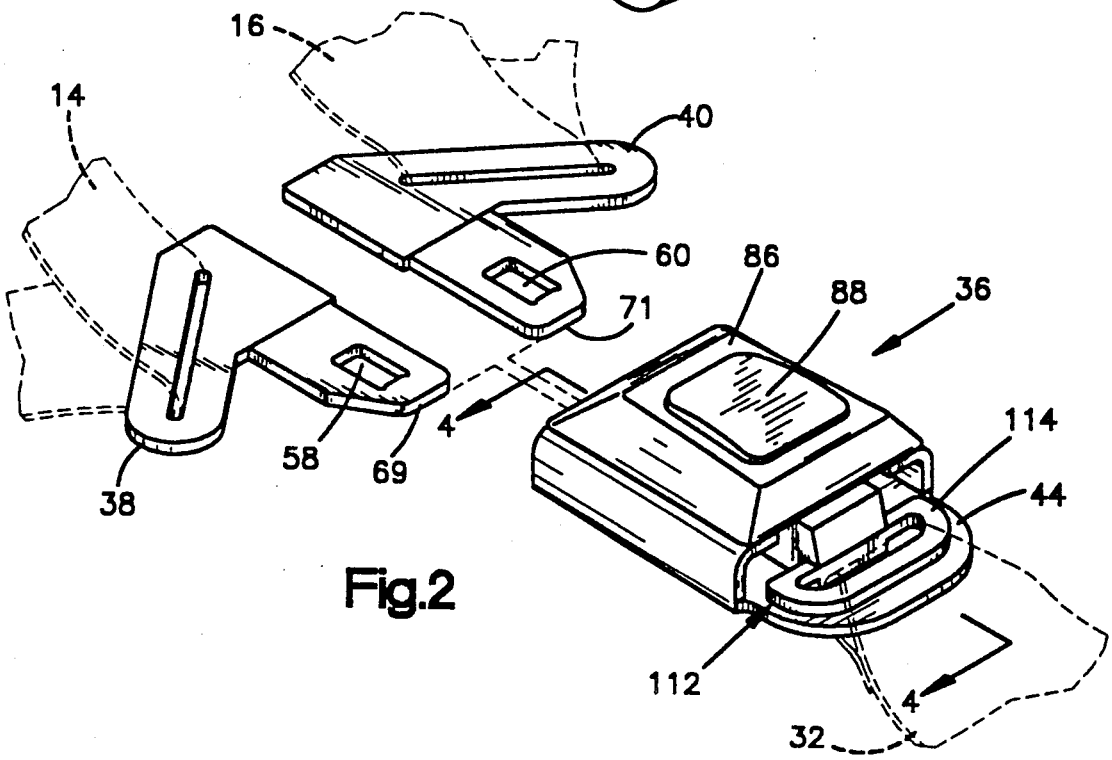
FIG. 2 is an illustration depicting the manner in which a pair of tongues are inserted into a buckle assembly to interconnect the tongues and the buckle assembly.
Figure 3:
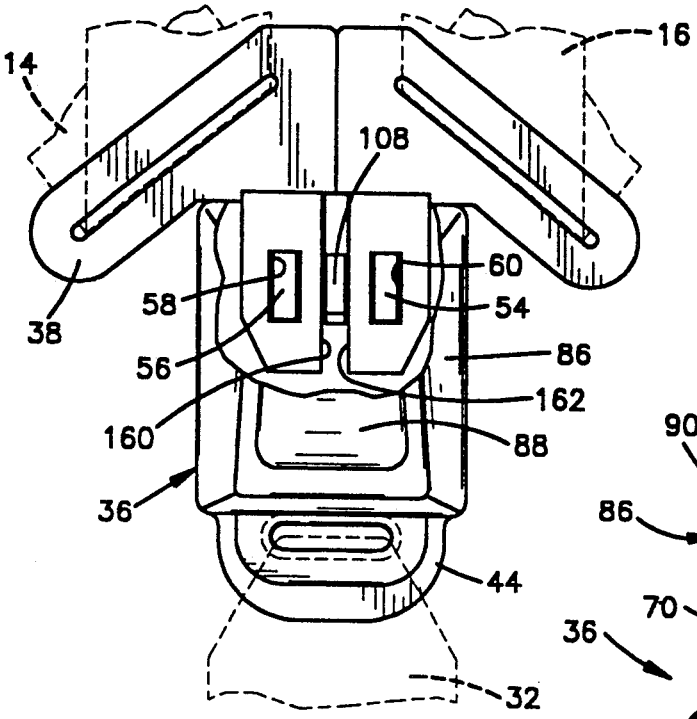
FIG. 3 is an illustration depicting the manner in which the tongue engage the buckle assembly.

The child restraint system 10 includes a crotch belt 32 which extends upwardly from a child seat cushion 34. A buckle assembly 36, constructed in accordance with the present invention, is attached to an upper end portion of the crotch belt 32. The buckle assembly 36 is engageable with a pair of tongues 38 and 40 (FIGS. 1-3) on the shoulder belts 14 and 16 to interconnect the shoulder belts and the crotch belt 32.

The buckle assembly 36 (FIGS. 4 and 5) includes a rectangular metal base 44 having a slot 46 for receiving the crotch belt 32. A metal latch member 50 is pivotally mounted at one end 74 on the base 44 for movement between an engaged position shown in FIG. 4 and a release position.

The latch member 50 is a generally planar metal piece having two latch lugs 54 and 56 which extend upwardly from the plane of the latch member. The latch lug 54 has a cam surface 70 facing an entrance opening 68 of the buckle assembly 36. The latch lug 56 has a cam surface 72 facing the entrance opening 68.

The latch member 50 has two actuator arms 98 and 100. The actuator arms 98 and 100 are located on opposite sides of the latch member 50 and partially define an opening 95 (FIG. 5) extending through the latch member. The latch member 50 also includes a divider tab 108. The divider tab 108 is a portion of the single piece of metal which forms the latch member 50. The divider tab 108 projects upwardly (as viewed in FIG. 4) from the plane of the base 44. The divider tab 108 is located at the center of the buckle assembly 36 as viewed from left to right in FIG. 3.

Figure 4:
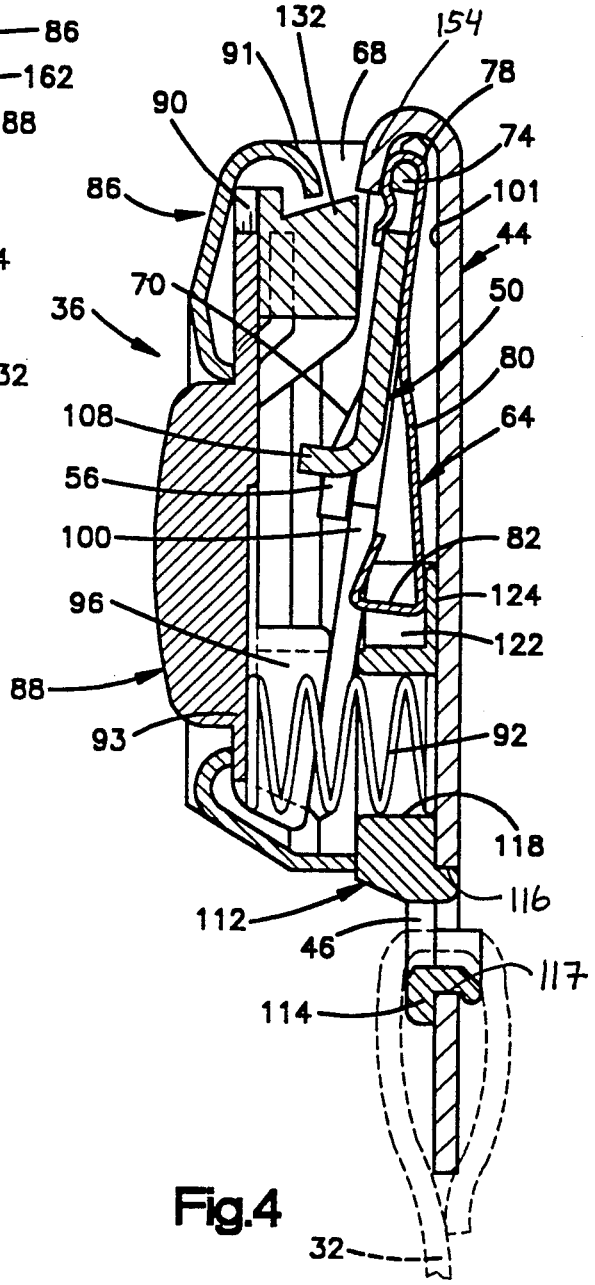
FIG. 4 is an enlarged sectional view of the buckle assembly of FIG. 2, taken generally along line 4—4 of FIG. 2.

The latch member 50 is urged to the engaged position, shown in FIG. 4, by a latch spring 64. The latch spring 64 is a metal leaf spring and is disposed between the latch member 50 and the metal base 44. A mounting end portion 78 of the latch spring 64 is hooked around (FIGS. 4 and 5) the end portion 74 of the latch member 50 to connect the latch spring to the latch member. An arcuate main section 80 of the latch spring 64 engages a lower side surface of the latch member 50 and urges the latch member to pivot in a clockwise direction (as viewed in FIG. 4) around its end portion 74.

A generally rectangular metal cover 86 is secured to the base 44. A one-piece molded plastic pushbutton 88, for moving the latch member 50 between its engaged and disengaged positions, is mounted on the cover 86. The pushbutton 88 has a end portion 90 (FIG. 4) which pivotally engages an inturned lip 91 on the cover 86. The pushbutton 88 pivots about a axis which is generally parallel to the axis about which the latch member 50 pivots. Further, the pushbutton 88 extends roughly parallel to the latch member 50.

Figure 5:
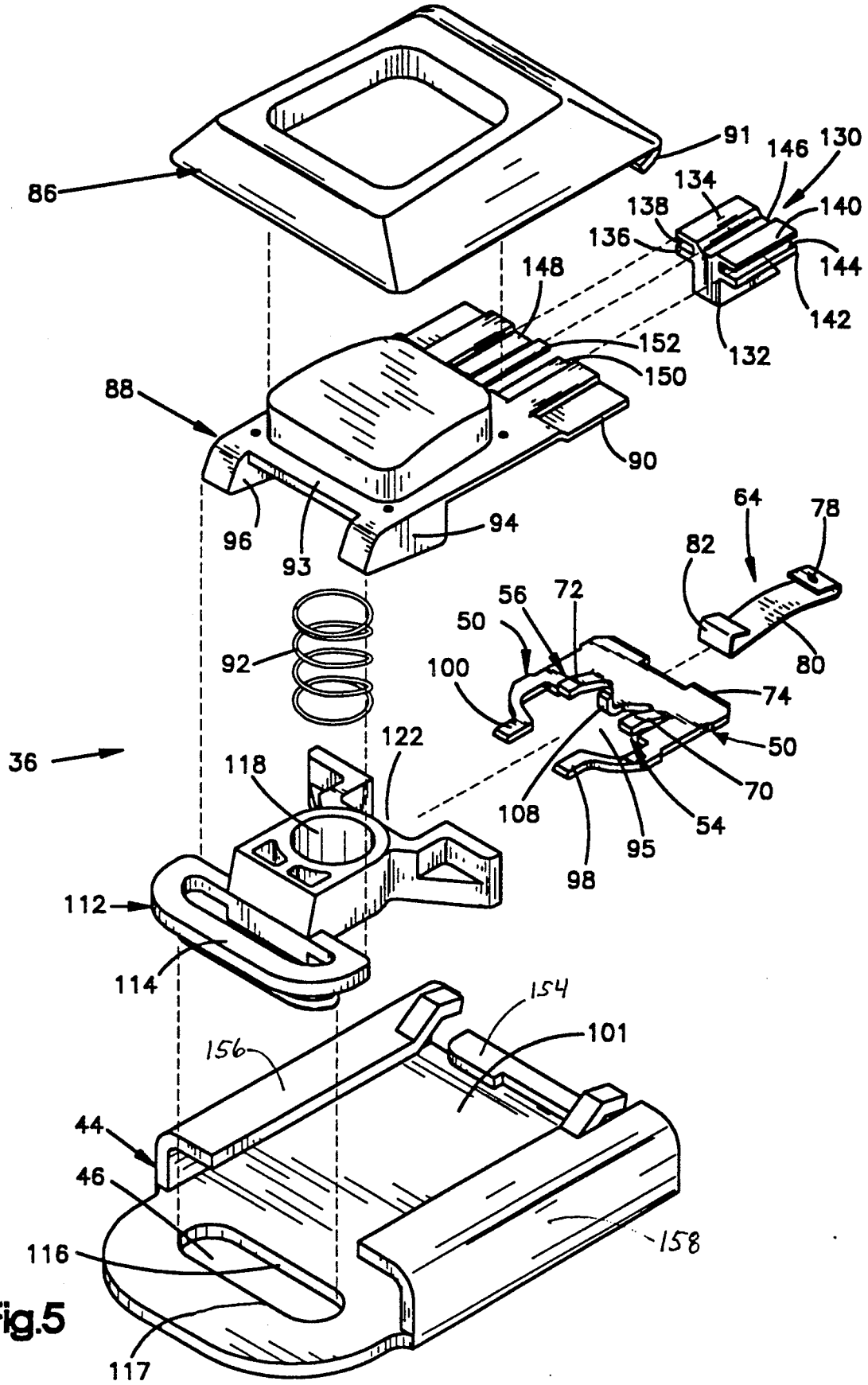
FIG. 5 is an exploded pictorial illustration of the components of the buckle assembly of FIG. 4.

The pushbutton 88 has on its other end portion 93 two downwardly depending actuator lugs 94 and 96 (FIG. 5). The actuator lugs 94 and 96 are located on opposite sides of the pushbutton 88 and are spaced outside the opening 95 (FIG. 5) extending through the latch member 50.

A coil spring 92 urges the pushbutton 88 to the raised position shown in FIG. 4. The coil spring 92 has a helical configuration. At one end, the coil spring 92 engages the end portion 93 of the pushbutton 88 opposite from the end portion 90 about which the pushbutton pivots. At its other end, the coil spring 92 engages the base 44. The coil spring 92 extends through the opening 95 in the latch member 50 between the actuator arms 98 and 100.

A one-piece molded plastic locator member 112 is mounted on the metal base 44 (FIGS. 4 and 5). A belt guard portion 114 of the locator member 112 extends along a major side surface 101 of the base 44 (FIG. 4) to the slot 46. The belt guard portion 114 extends into the slot 46 across a surface 116 of the base 44 which defines one side of the slot 46. The belt guard portion 114 wraps around the surface 117 which defines the other side of the slot 46 and extends along both major side surfaces of the base 44 adjacent the surface 117. The belt guard portion thus prevents the crotch belt 32 (FIG. 1) from rubbing against the metal base 44 (FIG. 4), which might result in abrasion of the crotch belt.

The locator member 112 has a cylindrical recess 118 in which an end portion of the coil spring 92 is received. The locator member 112 engages the turns of the coil spring 92 to hold the coil spring in position relative to the base 44 during movement of the pushbutton 88. In the illustrated embodiment of the invention, the recess 118 is open at its lower end so that the coil spring abuts the base 44. If desired, however, the recess 118 could be formed with an end wall which would be engaged by the coil spring 92.

A rectangular recess 122 (FIGS. 4 and 5) is also formed in the locator member 112. A head end portion 82 of the latch spring 64 extends into the recess 122 to position the latch spring relative to the base 44. The recess 122 has a relatively thin bottom wall 124 (FIG. 4) which is slidably engaged by the head end portion 82 of the latch spring 64. The head end portion 82 of the latch spring 64 is pressed against the bottom wall 124 by the main portion 80 of the latch spring. Since the locator member 112 is molded of a single piece of plastic, the bottom wall 124 is formed of plastic and has a relatively low coefficient of friction. Therefore, the head end portion 82 of the latch spring 64 ca readily move relative to the locator member 112 during deflection of the latch plate 50 and flexing of the latch spring 64.

A divider member 130 (FIGS. 4 and 5) is located at the entrance opening 68 of the buckle assembly 36. The divider member 130 is preferably a one-piece molded plastic part having a central body portion 132 (FIG. 5). A first pair of arms 134 and 136 project laterally from the central body portion 132 and define between them a recess 138. A second pair of arms 140 and 142 project laterally in the opposite direction from the central body portion 132 and define between them a recess 144. Between the arms 134 and 140 and over the central body portion 132 is a central recess 146.

The divider member 130 is slidably mounted on the end portion 90 of the pushbutton 88. A portion 148 of the pushbutton 88 is received in the recess 138 between the first pair of arms 134 and 136. A portion 150 of the pushbutton 88 is received in the recess 144 between the second pair of arms 140 and 142. A central tab portion 152 of the pushbutton 88 is received in the central recess 146. The pushbutton portions 148, 150 and 152 cooperate to grip between them the divider member 130 to retain the divider member on the pushbutton 88. The central body portion 132 of the divider member 130 is disposed between the insertion path of the tongue 38 and the insertion path of the tongue 40.

When child is to be secured in the restraint system 10, the shoulder belts 14 and 16 are positioned around the shoulders of the child. The crotch belt 32 extends upwardly between the child's legs. The tongues 38 and 40 are inserted into the buckle assembly 36 to interconnect the shoulder belts 14 and 16 and the crotch belt 32.

Each tongue is inserted into the buckle assembly along an insertion path defined by surfaces on the base 44 and on other components of the buckle assembly 36. The tongue 38 is inserted into the buckle assembly 36 along a first insertion path defined on the top by the lip 91 on the cover 86, and on the bottom by an upturned end portion 154 of the base 44 and by the latch member 50 and the latch lug 56. The first insertion path is defined on the outside by a flange portion 156 of the base 44, and on the inside (toward the center of the buckle assembly 36) by the central body portion 132 of the divider member 130 and by the tab portion 108.

The tongue 40 is inserted into the buckle assembly 36 along a second insertion path separate and distinct from the first insertion path. The second insertion path is defined on the top by the lip 91 on the cover 86, and on the bottom by the end portion 154 of the base 44 and by the latch member 50 and the latch lug 54. The second insertion path is defined on the outside by a flange portion 158 of the base 44 opposite from the flange portion 156, and on the inside (toward the center of the buckle assembly 36) by the central body portion 132 of the divider member 130 and by the tab portion 108.

When the tongues 38 and 40 are inserted into the buckle assembly 36 through the entrance opening 68, a leading edge 69 (FIG. 2) of the tongue 38 engages the cam surface 72 (FIG. 5) on the latch lug 56 A leading edge 71 of the tongue 40 engages the cam surface 70 on the latch lug 54. As the tongues 38 and 40 continue to be inserted into the buckle assembly 36, the latch member 50 is pivoted in a counterclockwise direction (as viewed in FIG. 4) about its end portion 74.

Pivotal movement of the latch member 50 is resisted by the latch spring 64. The pivotal movement of the latch member 50 continues until the latch lugs 54 and 56 snap into openings 58 and 60 in the tongues 38 and 40. The latch lugs 54 and 56 then hold the tongues 38 and 40 in the buckle assembly 36. The shoulder belts 14 and 16 are thus interconnected with the crotch belt 32, and the child is secured in the restraint system 10.

During insertion of the tongues 38 and 40 into the buckle assembly 36, the divider member 130 on the pushbutton 88 guides the tongue into their respective insertion paths. The divider member 130 is located at the entrance opening 68 of the buckle assembly 36. The central body portion 132 of the divider member 130 is disposed between the insertion path of the tongue 38 and the insertion path of the tongue 40. As each tongue 38 or 40 is inserted into the buckle assembly 36, the divider member 130 constrains the tongue for insertion only into its respective insertion path, and blocks movement of the tongue into the other insertion path. Thus, the divider member 130 guides the tongues 38 and 40 into their respective insertion paths. The divider member 130 also helps align the tongues 38 and 40 with their respective latch lugs 54 and 56.

The divider tab 108 on the latch member 50 helps maintain the tongues 38 and 40 in alignment with the latch lugs 54 and 56, respectively. The divider tab 108 projects upwardly at the center of the buckle assembly 36, between the tongue 38 and the tongue 40, when the tongues are in the buckle assembly 36. The divider tab 108 engages an inner side surface 160 (FIG. 3) of the tongue 38 and an inner side surface 162 of the tongue 40 to maintain the tongues in alignment with the latch lugs 54 and 56. The divider tab 108 resists cam-out of the tongues 38 and 40, i.e., rotational movement of the tongues within the buckle assembly 36 about an axis extending normal to the plane of the base 44.

To release the tongues 38 and 40 from the buckle assembly 36, the pushbutton 88 is manually actuated. The pushbutton 88 pivots in a counterclockwise direction (as viewed in FIG. 4) against the force of the coil spring 92. The lugs 94 and 96 (FIG. 5) on the pushbutton 88 engage the actuator arms 98 and 100 on the latch member 50 to pivot the latch member 50 in a counterclockwise direction against the force of the latch spring 64. The latch lugs 54 and 56 are moved out of the tongue openings 58 and 60, respectively. The tongues 38 and 40 can then be removed from the buckle assembly 36.

Figure 6:
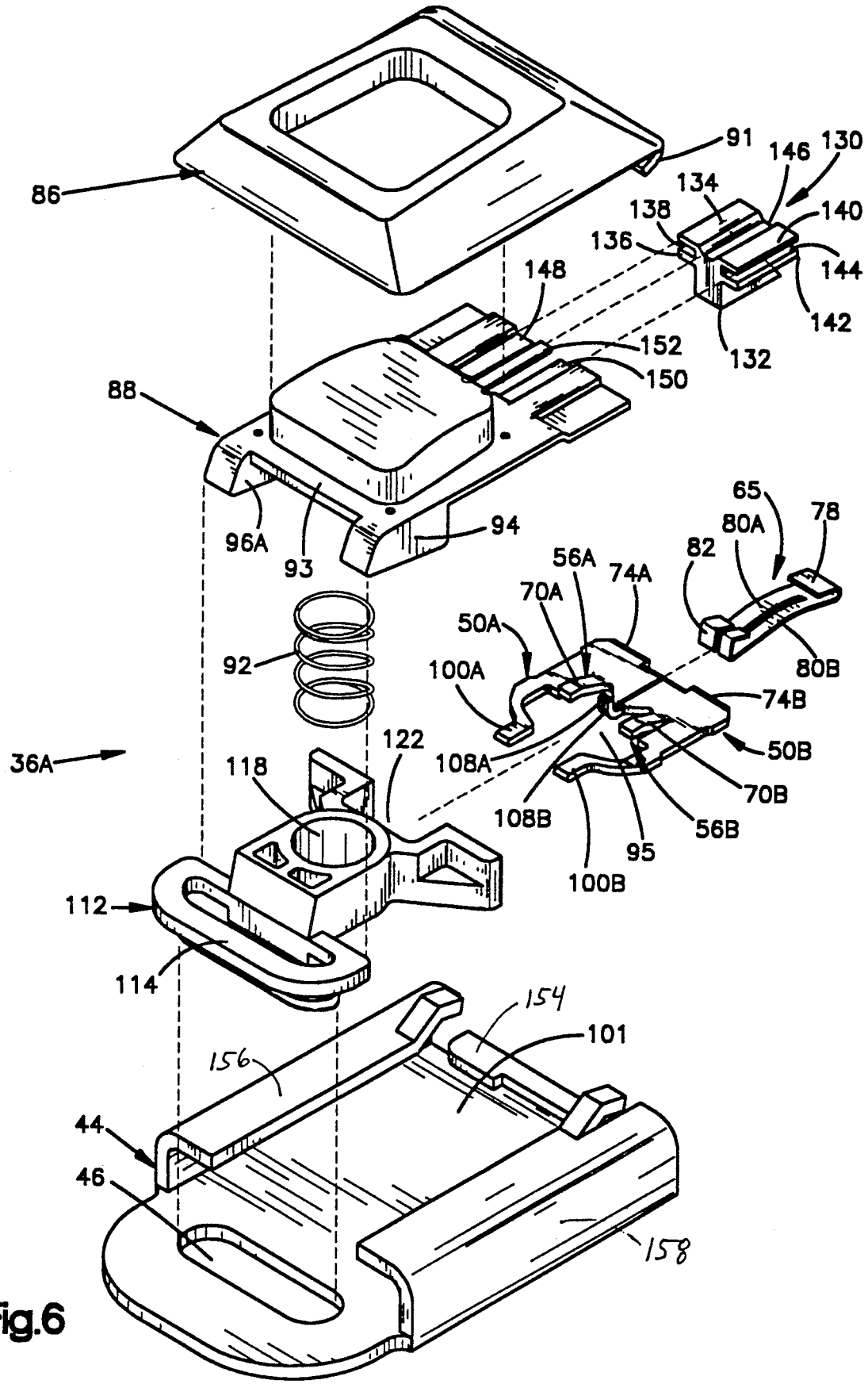
FIG. 6 is a view similar to FIG. 5 illustrating a buckle a two-piece latch.
Figure 7:
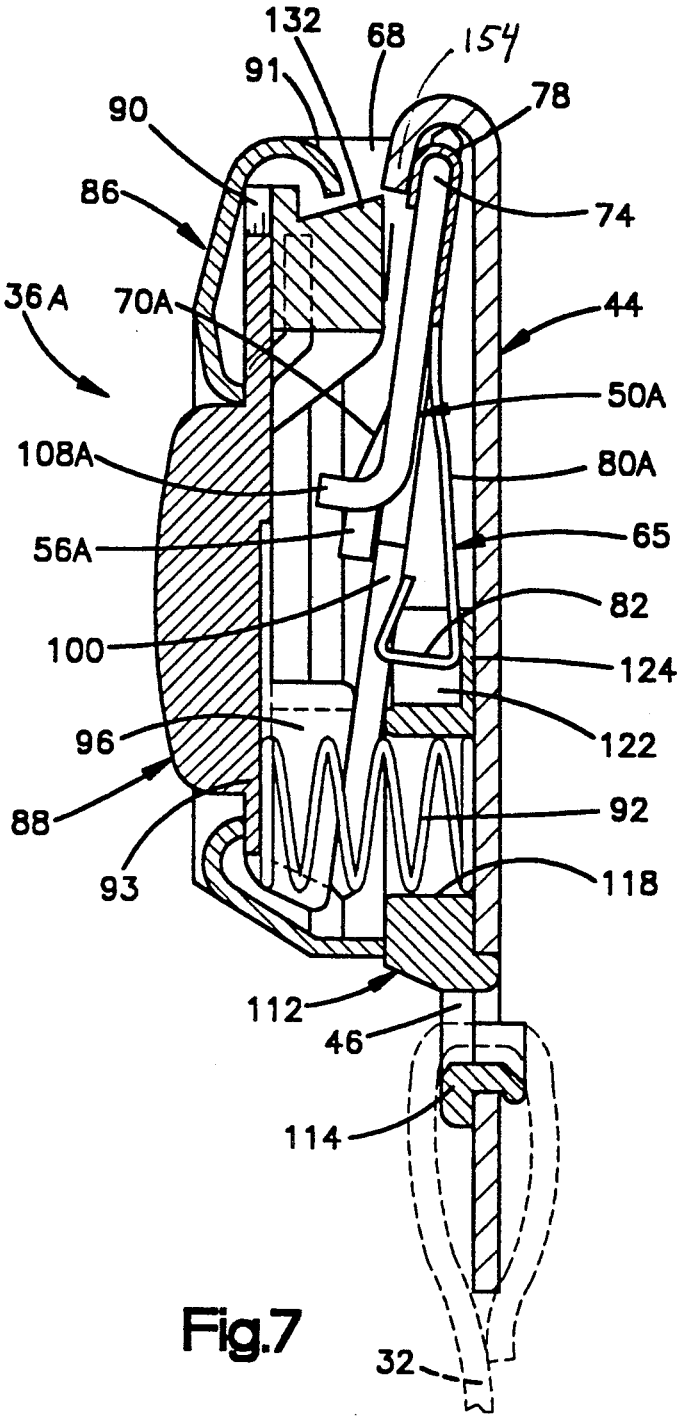
FIG. 7 is a sectional view similar to FIG. 4, taken along the longitudinal center line of the buckle assembly of FIG. 6.

FIGS. 6 and 7 illustrate another buckle assembly 36A constructed in accordance with the present invention. In the buckle assembly 36A, the latch for the tongues 38 and 40, instead of being one piece of metal, is made as two separate latch members 50A and 50B. The latch members 50A and 50B are movable independently of each other to provide independent latching of the tongue 38 and 40 in the buckle assembly 36A.

The latch member 50A is associated with the tongue 38. The latch member 50A is a generally planar piece of metal having a latch lug 56A which extends upwardly from the plane of the latch member. The latch lug 56A has a cam surface 70A facing the entrance opening 68 of the buckle assembly 36A. The latch member 50A also has an actuator arm 100A and an upwardly extending divider tab 108A. The latch member 50A is biased by a first leaf portion 80A of a leaf spring 65.

The latch member 50B is associated with the tongue 40. The latch member 50B is a generally planar piece of metal having a latch lug 56B which extends upwardly from the plane of the latch member. The latch lug 56B has a cam surface 70B facing the entrance opening 68 of the buckle assembly 36A. The latch member 50B also has a actuator arm 100B and an upwardly extending divider tab 108B. The divider tab 108B is located adjacent the divider tab 108A. The divider tabs 108A and 108B are at the same location in the buckle assembly 36A as the divider tab 108 is in the buckle assembly 36 (FIGS. 1-5). The latch member 50B is biased by a second leaf portion 80B of the leaf spring 65.

When a child is to be secured in a restraint system 10 incorporating a buckle assembly 36A, the shoulder belts 14 and 16 are positioned around the shoulders of the child. The crotch belt 32 extends upwardly between the child's legs. The tongues 38 and 40 are inserted into the buckle assembly 36A to interconnect the shoulder belts 14 and 16 and the crotch belt 32. As in the buckle assembly 36 (FIGS. 1-5), the divider member 130 on the pushbutton 88 guides the tongues into their respective insertion paths in the buckle assembly 36A.

When the tongue 38 is inserted into the buckle assembly 36A, the leading edge 69 (FIG. 2) of the tongue 38 engages the cam surface 70A (FIG. 5) on the latch lug 56A. As the tongue 38 is inserted further into the buckle assembly 36A, the latch member 50A is pivoted in a counterclockwise direction (as viewed in FIG. 4) about an end portion 74A of the latch member 50A. The latch lug 56A engages in the opening 58 in the tongue 38 to block movement of the tongue 38 out of the buckle assembly 36A.

The tongue 40 is also inserted into the buckle assembly 36A through the entrance opening 68. The leading edge 71 (FIG. 2) of the tongue 40 engages the cam surface 70B (FIG. 5) on the latch lug 56B. As the tongue 40 is inserted further into the buckle assembly 36A, the latch member 50B is pivoted in a counterclockwise direction (as viewed in FIG. 4) about an end portion 74B of the latch member 50B. The latch lug 56B engages in the opening 60 in the tongue 40 to block movement of the tongue 40 out of the buckle assembly 36A.

The latch members 50A and 50B are independent of each other. Thus, when the tongue 40 is inserted into the buckle assembly 36A to latch with the latch member 50B, the latch member 50A is not affected or moved. Similarly, when the tongue 38 is inserted into the buckle assembly 36A to latch with the latch member 50A, the latch member 50B is not affected or moved. It can thus be seen that if one or the other of the tongues 38 and 40 is already latched in the buckle assembly 36A, the insertion of the other tongue into the buckle assembly does not disengage the one tongue already latched. In contrast, in the buckle assembly 36 illustrated in FIGS. 1-5, insertion of either tongue 38 or 40 into the buckle assembly 36 pivots the one-piece latch member 50 to the disengaged position and disengages the one tongue which is already latched.

When the tongue 38 is in the buckle assembly 36A (FIGS. 6 and 7), the divider tab 108A on the latch member 50A engages the inner side surface 160 (FIG. 3) of the tongue 38 to maintain it in alignment with the latch lug 56A. When the tongue 40 is in the buckle assembly 36A, the divider tab 108B on the latch member 50B engages the inner side surface 162 of the tongue 40 to maintain it in alignment with the latch lug 56B. Each divider tab 108A and 108B resists cam-out of its associated tongue 38 and 40, i.e., resists rotational movement of the tongue within the buckle assembly 36A about an axis extending normal to the plane of the base 44.

To release the tongues 38 and 40 from the buckle assembly 36A the pushbutton 88 is manually actuated. The pushbutton 88 pivots in a counterclockwise direction (as viewed in FIG. 7) against the force of the coil spring 92. The lug 96 on the pushbutton 88 engages the actuator arm 100A on the latch member 50A to pivot the latch member 50A in a counterclockwise direction against the force of the latch spring portion 80A. The lug 94 on the pushbutton 88 simultaneously engages the actuator arm 100B on the latch member 50B to pivot the latch member 50B in a counterclockwise direction against the force of the latch spring portion 80B. The latch lugs 56A and 56B are thus moved out of the tongue openings 58 and 60, respectively. Therefore, depressing the pushbutton 88 simultaneously releases both tongues 38 and 40 from the buckle assembly 36A, and the tongues 38 and 40 can be removed from the buckle assembly 36A.

Although the buckle assemblies 36 and 36A have been disclosed herein in association with a child restraint system 10, either buckle assembly could be used in other restraint systems having a safety belt. For example, the child restraint system 10 has been illustrated in FIG. 1 as being permanently installed in association with the vehicle seat 12, with the child seat cushion 34 being folded down out of the seat back 22. Nonetheless, the child restraint system 10 could be used in association with a child seat which is separate from the vehicle seat 12 and is portable.

From the above description of the invention, those skilled in the art will perceive improvements, changes and modifications in the invention. Such improvements, changes and modifications within the skill of the art are intended to be covered by the appended claims.

I claim:

1. A buckle assembly for use in a safety belt system and for receiving first and second tongues, said buckle assembly comprising:

a base having surfaces at least partially defining a first insertion path for receiving the first tongue and a second insertion path spaced from the second insertion path for receiving the second tongue;

a latch mounted on said base and movable between an engaged position blocking movement of said tongues out of said buckle assembly and a release position allowing movement of the tongues out of said buckle assembly; and a manually engageable member in force-transmitting relationship with said latch and manually movable from a first position to a second position to move said latch from the engaged position to the release position to allow movement of the tongues out of said buckle assembly;

said latch having a tab portion disposed intermediate the first and second tongue insertion paths for guiding the tongues into said buckle assembly and for maintaining the tongues in latching engagement with said latch.

2. A buckle assembly as set forth in claim 1 wherein said latch is a single piece of metal and said tab portion comprises a projection on said single piece of metal having surfaces engageable with the first and second tongues when the tongues are inserted in said buckle assembly.

3. A buckle assembly as set forth in claim 2 wherein said surfaces engageable with the first and second tongues include a first surface engageable with an inner side surface of the first tongue and a second surface engageable with an inner side surface of the second tongue when the tongues are latched in said buckle assembly.

4. A buckle assembly as set forth in claim 1 wherein said tab portion is disposed intermediate the tongues at a location approximately midway across the width of said buckle assembly when the tongues are latched in said buckle assembly.

5. A buckle assembly as set forth in claim 1 wherein said latch includes two latch lugs for engagement respectively in corresponding openings of the respective tongues, said latch having a generally planar form and said latch lugs and said tab portion projecting in the same direction as each other from the plane of said latch.

6. A buckle assembly as set forth in claim 1, wherein said latch comprises first and second latch members mounted on said base, said first latch member being movable between an engaged position blocking movement of said first tongue out of said buckle assembly and a release position allowing movement of said first tongue out of said buckle assembly, said second latch member being movable independently of said first latch member between an engaged position blocking movement of said second tongue out of said buckle assembly and a release position allowing movement of said second tongue out of said buckle assembly.

7. A buckle assembly as set forth in claim 6, wherein said tab portion includes a first tab member on said first latch member and disposed intermediate the first and second tongue insertion paths and a second tab member on said second latch member and disposed intermediate the first and second tongue insertion paths adjacent said first tab portion.

8. A buckle assembly as set forth in claim 7 wherein said first tab member and said second tab member are disposed at a location approximately midway across the width of said buckle assembly.

9. A buckle assembly as set forth in claim 7 wherein said first tab portion on said first latch member has a first surface engageable with an inner side surface of the first tongue to control movement of the first tongue in said buckle assembly and said second tab portion on said second latch member has a second surface engageable with an inner side surface of the second tongue to control movement of the second tongue in said buckle assembly when the tongues are latched in said buckle assembly.

10. A buckle assembly as set forth in claim 7 wherein the tongues are generally planar and disposed in a common plane when inserted in said buckle assembly, said first and second tab members blocking rotation of the tongues about an axis normal to the plane of the tongues.

11. A buckle assembly for use in a safety belt system and for receiving first and second tongues, said buckle assembly having an entrance opening into which the tongues can be inserted, said buckle assembly comprising:

a base having surfaces at least partially defining a first insertion path for receiving the first tongue and a second insertion path spaced from the first insertion path for receiving the second tongue, a latch mounted on said base and movable between an engaged position blocking movement of the tongues out of said buckle assembly and release position allowing movement of the tongues out of said buckle assembly;

a pushbutton mounted on said base in force-transmitting relationship with said latch for pivotal movement from a first position to a second position to move said latch from the engaged position to the release position to allow movement of the tongues out of said buckle assembly; and a divider member attached to said pushbutton at the entrance opening of said buckle assembly for guiding the first tongue into the first insertion path and for guiding the second tongue into the second insertion path.

12. A buckle assembly as set forth in claim 11 wherein said divider member has side portions in gripping engagement with said pushbutton and securing said divider member to said pushbutton and a central portion depending from said pushbutton at a location intermediate the first and second insertion paths.

13. A buckle assembly as set forth in claim 11 wherein said divider member is slidably connected with an end portion of said pushbutton and includes first and second arms spaced about a portion of said pushbutton to retain said divider member on said pushbutton.

14. A buckle assembly as set forth in claim 11 wherein said latch comprises first and second independent latch members associated with respective ones of the first and second tongues, each of said first and second latch members having a latching position and a disengaged position not latching its respective tongue in said buckle assembly, each one of said first and second latch members being movable from its latching position to its disengaged position without moving the other one of said first and second latch members out of its latching position.

15. A buckle assembly for use in a safety belt system and for receiving first and second tongues, said buckle assembly comprising:

a base having surfaces at least partially defining a first insertion path for receiving said first tongue and a second insertion path spaced from the first insertion path for receiving said second tongue, a latch mounted on said base and movable between an engaged position blocking movement of said tongues out of said buckle assembly and a release position allowing movement of said tongues out of said buckle assembly;

a pushbutton mounted on said base in force-transmitting relationship with said latch;

means for supporting said pushbutton for pivotal movement on said base between a first position and a second position to move said latch from the engaged position to the release position to allow movement of said tongues out of said buckle assembly; and a divider member attached to an end portion of said pivotally mounted pushbutton and having a portion projecting from said pivotally mounted pushbutton into a location in said buckle assembly intermediate the first and second tongue insertion paths, said divider member guiding the first tongue into said first insertion path and the second tongue into said second insertion path.

* * * * *